United States Patent [19]

Austin

[11] 4,277,506

[45] Jul. 7, 1981

[54] SUPPORTIVE SIDEWALL CONTAINER FOR EXPANDABLE FOOD PACKAGES

[75] Inventor: John J. Austin, LaGrange, Ill.

[73] Assignee: Champion International Corporation, Stamford, Conn.

[21] Appl. No.: 115,026

[22] Filed: Jan. 24, 1980

[51] Int. Cl.[3] ..... B65D 81/34; B65B 29/08

[52] U.S. Cl. ..... 426/111; 220/403; 220/462; 229/33; 229/DIG. 3; 426/124; 426/234

[58] Field of Search ..... 426/111, 124, 107, 234; 229/33, 31 R, 41 C, 41 D, 8, DIG. 3, 36; 220/403, 404, 410, 462

[56] References Cited

U.S. PATENT DOCUMENTS

| | | | |
|---|---|---|---|
| 2,243,080 | 5/1941 | Brogden | 229/33 |
| 2,819,976 | 1/1958 | Hines | 426/111 |
| 3,040,957 | 6/1962 | Meyers | 229/33 |
| 3,184,147 | 5/1965 | Wolowier | 229/33 |
| 3,507,668 | 4/1970 | Bridgford | 229/33 |
| 3,733,023 | 5/1973 | Arneson | 229/31 R |
| 3,734,749 | 5/1973 | Bridgford | 426/111 |
| 3,851,574 | 12/1974 | Katz et al. | 426/107 |
| 3,873,738 | 3/1975 | Zoeller et al. | 426/111 |
| 4,036,423 | 7/1977 | Gordon | 426/111 |

FOREIGN PATENT DOCUMENTS

| | | | |
|---|---|---|---|
| 1110600 | 10/1954 | France | 229/33 |
| 2223250 | 11/1974 | France | 229/31 R |

*Primary Examiner*—Steven L. Weinstein
*Attorney, Agent, or Firm*—Evelyn M. Sommer

[57] ABSTRACT

A paperboard container for use in a microwave oven to cook an expandable food has a square bottom support panel, upwardly and outwardly tapering, concave, trapezoidal side panels connected to each edge of the bottom support panel, and a cover of overlapped, top panels. A top panel is foldably connected to an upper arcuate edge of each of the side panels and a seal is removably attached to one of the top panels and an opposed one thereof to close the container. Upon expansion of the food within the container in a microwave oven, the concave side panels will expand to aid in confining the food within the perimeter of the container.

12 Claims, 8 Drawing Figures

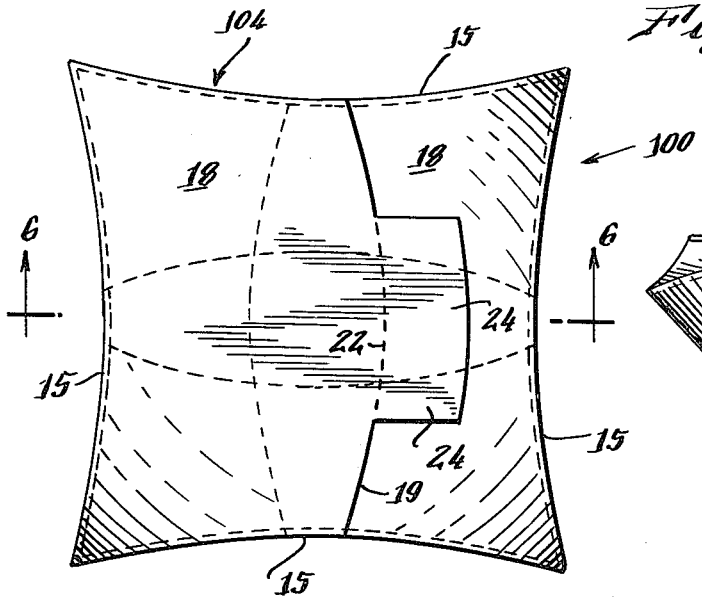
Fig. 4.
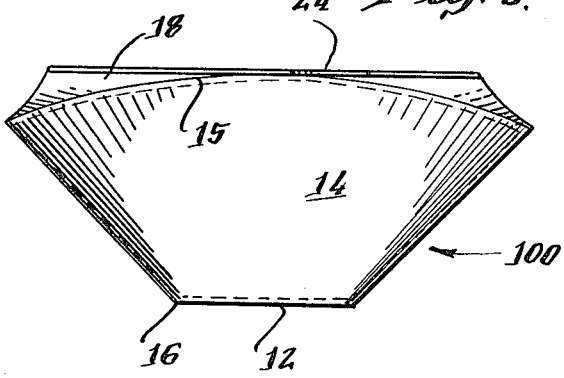
Fig. 5.
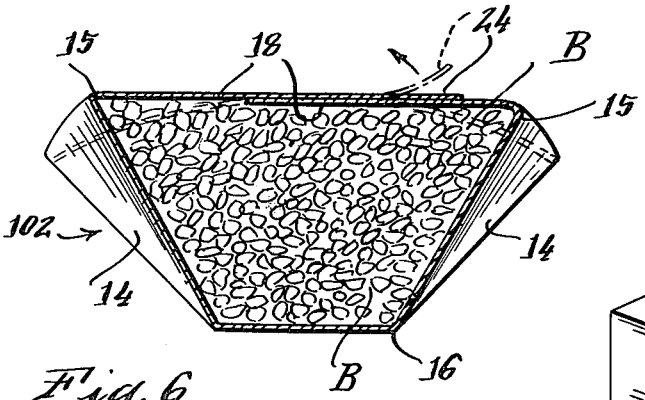
Fig. 6.
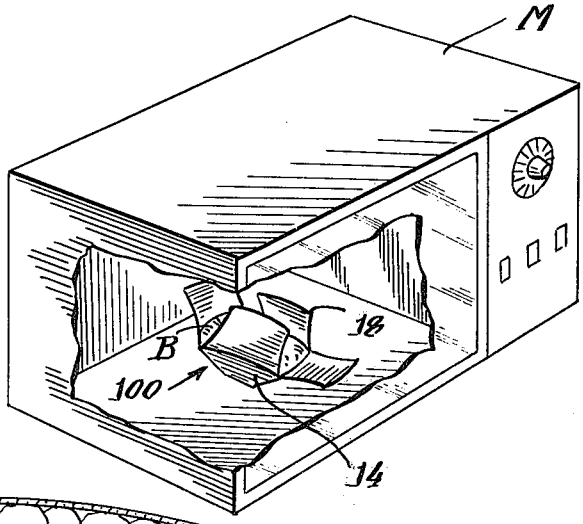
Fig. 7.
Fig. 8
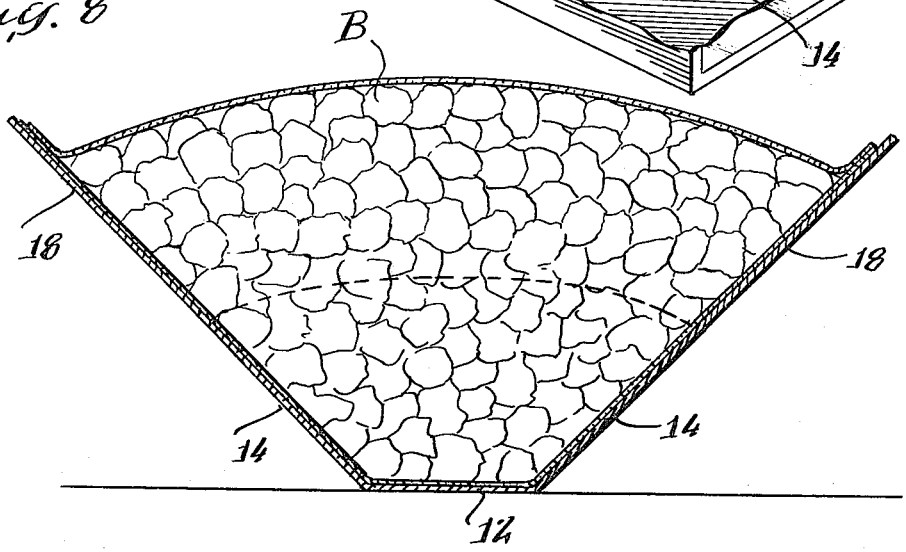

SUPPORTIVE SIDEWALL CONTAINER FOR EXPANDABLE FOOD PACKAGES

BACKGROUND OF THE INVENTION

1. Field of the Invention

This invention relates to a novel container, and more particularly, to a container for housing an expandable food package in a stored, non-expanded condition and in an expanded condition having substantially increased volume, the container being constructed of non-metallic materials for use in a microwave oven.

2. Description of the Prior Art

Expandable food packages have been constructed for use, for example, in packaging and cooking corn kernels to form popcorn. Generally, the package is placed over a heat source under the influence of which cooking fats or oils, placed in the package, melt and form a gas while simultaneously the corn kernels are cooked to form the popcorn. The combination of expanding gas and puffing of the corn kernels cause the package to expand.

Prior art packages and containers for cooking such an expandable food generally utilize a shallow metal container for holding the food to be cooked by a thin aluminum foil cover. The cover expands under the influence of internal pressure from the cooked food to provide an internal volume greater than the original size, enabling the cooked food to be retained within the metallic container. An example of such a container or package is illustrated in U.S. Pat. No. 3,244,356 to Wolowicz, issued Apr. 5, 1966.

A principal advantage of using an expandable package in a container in which cooking can be performed, is the resulting economy of space in the storing and stacking of the packaged containers. Another advantage is the convenience for the user of not having to transfer or handle the cooking ingredients stored in the package. Unfortunately, packages incorporating metals, such as aluminum foil, cannot be used in a microwave oven because the metal acts as a shield, thereby preventing the energy from reaching the food to cook it. Therefore, in such packages, the food cannot be heated and cooked. As a result, it has become necessary to design a container for an expandable food package which is entirely non-metallic, so it can be used in a microwave oven heating environment.

One such package is illustrated in U.S. Pat. No. 4,036,423, issued to Gordon on July 19, 1977. In this patent, a non-metallic container for an expandable food package is formed from sheet material such as paperboard, polyethylene, paperboard lamination or combinations thereof sufficiently resistant to leakage of cooking oils and fats. The container includes a base portion and a cover. The base portion includes an open container section having a polygonally-shaped bottom panel having side panels connected thereto which taper upwardly and outwardly to receive food, such as uncooked kernels of corn with congealed cooking oil. An expandable cover is integrally attached to a flange portion connected to the side panels of the container along its entire outer periphery to enclose the base portion and food within the container. The flange and integral cover are then folded on top of the base and side panels to complete the construction. In use, the flanges are unfolded and the cover allowed to expand upon heating of the corn kernels and congealed cooking oil in a microwave oven; the cover expanding as the kernels expand. After cooking, the cover can be removed to expose the kernels for eating.

A principal disadvantage of the container illustrated in U.S. Pat. No. 4,036,423 is that the expandable cover is formed integrally with the container. This requires an additional manufacturing step during the formation of the container and requires the modification of standard carton closing machines in the manufacture of the finished container, both of which are highly undesirable, as they increase the cost of manufacture of the container.

Furthermore, the expanded food product has little room to expand laterally without causing rupture of the container side walls. Accordingly, the area of expansion of the product cannot be readily controlled within the perimeter or confines of the container, but must rely on the elasticity of the packaging material and/or integral cover on the container, which may prematurely rupture before cooking is complete, causing the expanded food product to be thrown from the container.

In accordance with the present invention, the expandable food package is completely separate from the container and is loaded into the container prior to closing the same.

The container of the present invention also features arcuate, concave side walls whereby the sides of the container can expand to confine the expanded food product within the perimeter of the container upon heating in a microwave oven.

Finally, the container is formed from paperboard or chemically treated, grease-resistant paperboard lamination whereby it is especially suited for use in a microwave oven.

SUMMARY OF THE INVENTION

The container of the present invention includes a bottom support panel of a regular polygonal shape, preferably a square. Upwardly and outwardly extending side panels are connected to each edge of the polygonally shaped bottom support panel. Each one of the side panels includes an upper arcuate edge and is connected to adjacent ones thereof by overlapping flanges to form with the bottom support panel a bowl having expandable concave side walls adapted to receive an expandable food bag or package in stored condition. A cover is adapted to enclose and store the expandable food bag or package in the bowl when closed, and to provide additional side support for the bag when opened and the bag is expanded.

The cover includes a plurality of overlapped, separate top panels. Each panel has an arcuate bottom edge foldably connected to the arcuate top edge of one of the side panels. The side edges of each top panel are also arcuate to complement the shape of the upper edge of an adjacent side wall. One of the top panels is connected by a perforated score line to a seal or tab.

To close the cover over the stored expandable bag or package, the top panels are folded about their arcuate fold lines to the side panels and are of a length so that the top edges of opposed panels overlap. The tab is adhesively secured to the top portion of an opposed top panel. This maintains the integrity of the package until it is ready to be used.

When the package is ready to be used, it is placed in a microwave oven. The top seal or tab is pulled upwardly and removed from the package. The perforated score line enables ready breaking away and removal of the seal from the container.

The effect of the microwave energy on the package is to build up internal pressure within the expandable bag causing expansion of the same within the bowl-shaped container. The expandable concave side walls enable the expansion to be confined substantially within the perimeter of the container, with top panels forming an extension of the side panels to further contain the expanded food product after it has been cooked.

BRIEF DESCRIPTION OF THE DRAWINGS

Further objects and advantages of the invention will appear from the following description and claims, and from the accompanying drawings, wherein:

FIG. 4 is a top plan view of the folded container of the present invention;

FIG. 5 is a side view in elevation of the container of FIG. 4, as seen from the right hand side of FIG. 6;

FIG. 6 is a cross-sectional view taken substantially along the plane indicated by line 6—6 of FIG. 4;

FIG. 7 is a broken away perspective view of the container of the present invention placed in a microwave oven to cook an expandable food housed in the container; and FIG. 8 is a longitudinal cross-sectional view through a container of the present invention after an expandable food in the container has been cooked in a microwave oven.

DESCRIPTION OF THE PREFERRED EMBODIMENT

Figure 1:
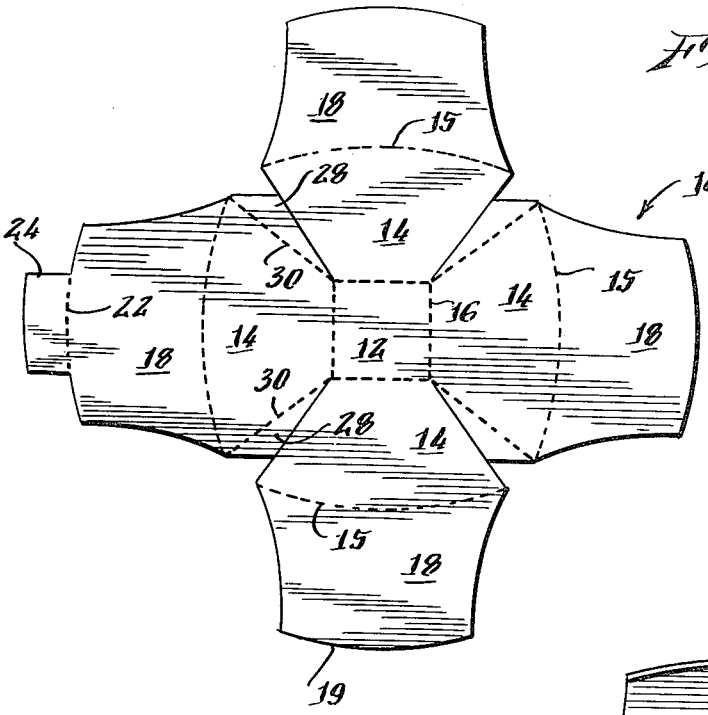
FIG. 1 is a plan view of a blank for forming the container of the present invention.

Referring now to the drawings in detail, wherein like numerals indicate like elements throughout the several views, the container 100 of the present invention is illustrated in FIGS. 4 to 6, inclusive.

Container 100 has a base portion 102 including a bottom support panel 12 of a regular polygonal shape, preferably a square. Base portion 102 further includes an upwardly and outwardly extending side wall panel 14 foldably connected to each free edge 16 of the polygonally shaped bottom support panel 12. Each one of said side panels 14 is connected to an adjacent one thereof to form with said bottom support panel 12 the bowl-shaped base portion 102 which is adapted to receive an expandable food bag B in stored condition, as shown in FIG. 6.

The top edge 15 of each side wall panel 14 is arcuate. Each side wall panel 14 is connected an an adjacent panel 14 by overlapping V-shaped panels 28 connected by a score line 30 to opposed edges of every other panel 14. The construction results in the bowl-shaped base portion 102 having expandable concave side wall panels 14, as shown in FIG. 6 to receive expandable food bag B. Upon heating and expansion of bag B in a microwave oven, the side wall panels 14 will expand from a concave to a slightly convex shape, as shown in FIG. 8, to confine and support the expansion of bag B substantially within the perimeter of container 100.

Container 100 also includes a cover 104. Cover 104 is adapted to enclose and store expandable food bag B in the bowl shaped base portion 102 of container 100 when closed and provide additional side support for the bag B when the bag is expanded in a microwave oven.

Cover 104 comprises a plurality of overlapped, separate top panels 18 of generally rectangular shape. A panel 18 has its lower edge resiliently and foldably connected to the top edge 15 of one of the side panels 14.

One of the top panels 18 is connected by a perforated score line 22 to a generally rectangular seal or tab 24. In forming the cover to enclose the expandable bag B, each of the rectangular top panels 18 is folded about the edge 15 and are overlapped, as shown in FIGS. 4 to 6. The top panels 18 are folded about arcuate fold lines 15 and are of a length so that the top edges 19 of opposed panels 18 overlap and one pair of opposed panels 18 are seated on a second pair. The tab or seal 24 is then adhesively secured to the top portion of the opposed top panel 18. This maintains the integrity of the package until it is ready to be used.

When the container 100 is ready to be used, it is placed in a microwave oven M. The top seal or tab 24 is pulled upwardly and removed from the container. The perforated score line 22 enables ready breaking away and removal of the seal 24 from container 100.

The effect of the microwave energy on the container 100 is to build up internal pressure within the expandable bag B causing expansion of the same within bowl-shaped base 102. The expandable concave side walls 14 enable the expansion to be confined substantially within the perimeter of container 100, with the top panels 18 forming an extension of the side wall panels 14 to further contain the expanded food product after it has been cooked.

The container 100 is formed from paperboard or a grease-resistant, specially chemically treated leak-proof paperboard lamination. The container 100 is formed from the blank 10 illustrated in FIG. 1.

Figure 2:
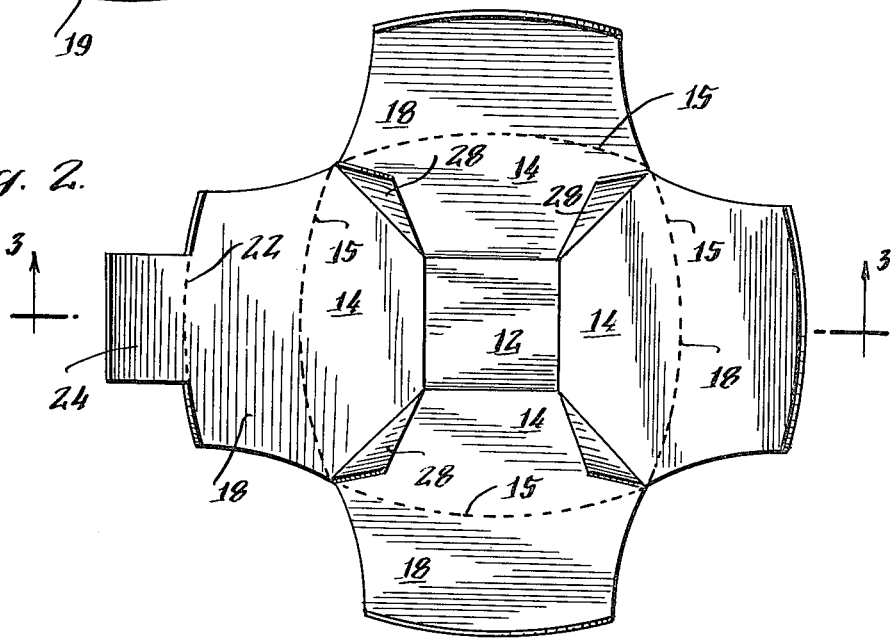
FIG. 2 is a view similar to FIG. 1, but illustrating the blank partially folded.
Figure 3:
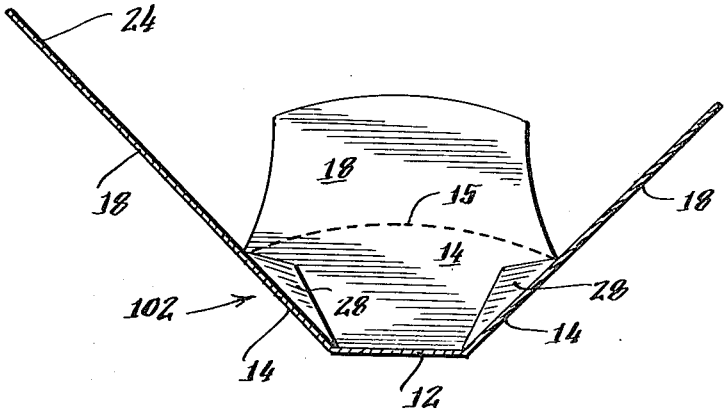
FIG. 3 is a cross-sectional view taken substantially along the plane indicated by line 3—3 of FIG. 2.

Blank 10 includes the regular polygonally shaped bottom support panel 12, and as illustrated, the preferred shaped is square. Secured to each edge 16 of square bottom support panel 12 are generally tapezoidal shaped side panels 14 terminating in an arcuate top edge 15. Every other side panel includes the substantially V-shaped panel 28 connected by a score line 30 to opposed edges thereof. Panels 28 are overlapped with an adjacent side panel 14 and are adhesively bonded thereto as shown in FIG. 2 in order to provide the upward and outward taper, as well as the concave shape, to the side panels 14 extending from bottom support panel 12, thereby forming the bowl-shaped base of 102 of the container 100.

Top panels 18 are foldably connected to the top edge 15 of each of the side panels 14. The tab 24 is connected by the perforated score line 22 to one of the rectangular top panels 18.

What is claimed as new is:

1. A non-metallic container housing an expandable food bag in a non-expanded stored condition and in an expanded condition upon heating, having a substantially increased volume, said container comprising:

a base portion including a bottom support panel of regular polygonal shape, an upwardly and outwardly extending side panel connected to each edge of said polygonally shaped bottom support panel, with the distal edge of each said side panel being arcuate in configuration, with each one of said side panels being connected to the adjacent one thereof by overlapping V-shaped extension panels and being bowed radially inwardly in a concave configuration to form with said bottom support panel a bowl receiving said expandable food bag in stored condition, and an integral cover enclosing and storing said expandable food bag in said bowl and providing additional side support for the bag when open and the bag is expanded, said cover including a plurality of overlapped, separate top panels, each top panel having an edge, resiliently and foldably connected to one of said side panels, along the arcuate edge thereof, each top panel also having an arcuate top edge and side edges to compliment the shape of the upper edge of an adjacent side panel one of said top panels being removably connected to a seal-tab, and said seal being releasably attached to at least one of said remaining top panels, such that when said seal is released enabling the top panels of said cover to be opened, said side panels are capable of expanding and bowing radially outwardly to define a convex configuration thereby providing increased volume for said expandable food bag while confining said food bag within said container.

2. The container of claim 1 wherein said base portion and cover portion are formed from paperboard material.

3. The container of claim 2 wherein said bottom support panel is square in shape and each of said side panels is substantially trapezoidal in shape, one of the edges of each of said trapezoidal side panels being connected to one of the edges of said square-shaped bottom panel.

4. The container of claim 3 wherein every other side panel includes a V-shaped extension panel connected to opposite edges thereof which is overlapped and adhered to an adjacent side panel.

5. The container of claim 4 wherein said seal is rectangular in shape.

6. The container of claim 5 wherein each of said top panels is generally rectangular in shape and includes a base foldably connected to one of the edges of one of said trapezoidal side panels.

7. The container of claim 6 wherein said seal is connected to said one of said top panels along a perforated score line.

8. The container of claim 1 wherein said seal is connected to said one of said top panels along a perforated score line.

9. The container of claim 1 wherein said bottom support panel is square in shape and each of said side panels is substantially trapezoidal in shape, one of the edges of each of said trapezoidal side panels being connected to one of the edges of said square-shaped bottom panel.

10. The container of claim 1 wherein every other side panel includes a V-shaped extension panel connected to opposite edges thereof which is overlapped and adhered to an adjacent side panel.

11. The container of claim 1 wherein said seal is rectangular in shape.

12. The container of claim 1 wherein each of said top panels is generally rectangular in shape.

* * * * *